United States Patent [19]

Kataoka

[11] 4,399,790

[45] Aug. 23, 1983

[54] AIR-FUEL RATIO CONTROL SYSTEM

[75] Inventor: Ryuji Kataoka, Tokyo, Japan

[73] Assignees: Fuji Jukogyo Kabushiki Kaisha, Tokyo; Nissan Motor Co., Ltd., Yokohama, both of Japan

[21] Appl. No.: 214,605

[22] Filed: Dec. 9, 1980

[30] Foreign Application Priority Data

Dec. 13, 1979 [JP] Japan ..... 54-162072

[51] Int. Cl.[3] ..... F02B 33/00; F02M 7/00

[52] U.S. Cl. ..... 123/440; 123/492; 123/493

[58] Field of Search ..... 123/492, 493, 440

[56] References Cited

U.S. PATENT DOCUMENTS

| | | | |
|---|---|---|---|
| 4,075,982 | 2/1978 | Asano | 123/440 |
| 4,111,162 | 9/1978 | Norimatsu | 123/440 |
| 4,131,091 | 12/1978 | Asano | 123/440 |
| 4,144,847 | 3/1979 | Hosaka | 123/440 |
| 4,173,952 | 11/1979 | Asano | 123/440 |
| 4,187,812 | 2/1980 | Hosaka | 123/440 |
| 4,227,507 | 10/1980 | Takase | 123/440 |
| 4,240,389 | 12/1980 | Shimazaki | 123/440 |

*Primary Examiner*—Ronald B. Cox
*Attorney, Agent, or Firm*—Martin A. Farber

[57] ABSTRACT

An electronic control system for controlling the air-fuel ratio for an internal combustion engine comprising an oxygen sensor for detecting the concentration of oxygen in exhaust gases of the engine, an on-off type electromagnetic valve for correcting the air-fuel ratio of the air-fuel mixture supplied by an air-fuel mixture supply device, a comparator for evaluating the output signal of the oxygen sensor, an integrating and a proportional circuit connected to the comparator, and a driving circuit for producing pulses for driving the on-off type electromagnetic valve from output signals of the integrating circuit and proportional circuits for controlling the air-fuel ratio to a value substantially equal to the stoichiometric air-fuel ratio. A potentiometer-type transducer converts the operation of the throttle valve to an electric output, and a differentiating circuit differentiates the output of the transducer. The constants of the integrating and proportional circuits are increased by the differentiation signal from the differentiating circuit upon acceleration and deceleration of the engine.

7 Claims, 4 Drawing Figures

Electromagnetic valves
15
Driving circuit
27
C
26
Summing circuit
Differentiating circuit
21
28
24
B
25
Integrating circuit
23
Comparator
Proportional circuit
A
Throttle sensor
20
22
Set value circuit
19
Oxygen sensor acceleration
deceleration
throttle valve opening (θ)

t (time)
output of differential circuit
+
0
− output of summing circuit
D
E
proportional control
integration control
proportional control
integration control

AIR-FUEL RATIO CONTROL SYSTEM

BACKGROUND OF THE INVENTION

The present invention relates to a system for controlling the air-fuel ratio of an internal combustion engine emission control system with a catalytic convertor comprising a three-way catalyst.

Such a control system comprises a feedback control system, the system comprising an oxygen sensor for detecting the concentration of oxygen in the exhaust gases, an air-fuel mixture supply unit, an electromagnetic valve for correcting the air-fuel ratio of the air-fuel mixture supplied by the air-fuel mixture supply unit, and an electronic control circuit. The electronic control circuit comprises a comparator for comparing the output signal of the oxygen sensor with a predetermined value, a proportional circuit and an integrating circuit connected to the comparator for integrating the output of the comparator, and a driving circuit connected to the proportional and integrating circuits for producing a driving signal for driving the electromagnetic valve. The oxygen sensor generates an electrical signal as an indication of the air-fuel ratio of the air-fuel mixture induced in the engine cylinder.

The output voltage of the oxygen sensor is higher than a predetermined voltage when the oxygen concentration of the exhaust gases is smaller than a predetermined ratio corresponding to the stoichiometric air-fuel ratio in the air-fuel mixture for the combustion of the mixture and is lower than the predetermined voltage when the oxygen concentration is greater than the predetermined ratio. The control system operates to actuate the electromagnetic valve to correct the air-fuel ratio of the mixture to be supplied to the cylinder to the stoichiometric air-fuel ratio in dependency upon the output voltage of the oxygen sensor. The constant of the proportional circuit and the constant of the integrating circuit are selected to proper values respectively for providing an effective purification reaction in the three-way catalyst during normal operation of the engine during which the air-fuel ratio of the mixture is substantially constant. On the other hand, the air-fuel ratio varies with acceleration and deceleration of the engine and the purification effect of the emission control system decreases by the variation of the air-fuel ratio caused by such engine operating conditions.

It has been found that if the circuit constant is increased depending on the increase of the acceleration and deceleration, decrease in the purification effect of the system may be prevented.

SUMMARY OF THE INVENTION

The object of the present invention is to provide an electronic control system in which the circuit constant is adjusted according to the acceleration and deceleration of the engine for performing the optimum air-fuel ratio control.

According to the present invention, there is provided in a system for controlling the air-fuel ratio for an internal combustion engine having a carburetor with an intake passage, air-fuel mixture supply means for supplying an air-fuel mixture to the intake passage, an exhaust passage communicating with the engine, a throttle valve, detecting means for detecting the concentration of a constituent of exhaust gases passing through said exhaust passage and producing an output signal dependent thereon, a comparator for comparing said output signal of said detecting means with a set valve and producing an output signal dependent thereon, an integrating circuit and a proportional circuit connected to said comparator, a driving and proportional circuits connected to said integrating circuit for producing an output signal in dependency on said output signal of said integrating circuit, and an electromagnetic valve means actuated by the output signal of said driving circuit for correcting the air-fuel ratio of the air-fuel mixture supplied by said air-fuel mixture supply means, throttle sensing means for detecting the operation of said throttle valve and producing an output signal dependent on the magnitude of acceleration and deceleration of said internal combustion engine, a circuit for varying the constant of said integrating and proportional circuits, a differentiating circuit for differentiating the output signal of said throttle sensing means and producing an output signal dependent on the acceleration and deceleration, a rectifier means for rectifying said output of differentiating circuit means, and semiconductor element means having a resistance which varies proportionally with the variation of the voltage applied thereto for increasing the constant of said integrating and proportional circuits with an increase of the output of said differentiating circuit means.

Other objects and feature of the present invention will become apparent from the following description with reference to the accompanying drawings.

DETAILED DESCRIPTION OF THE PREFERRED EMBODIMENT

Figure 1:
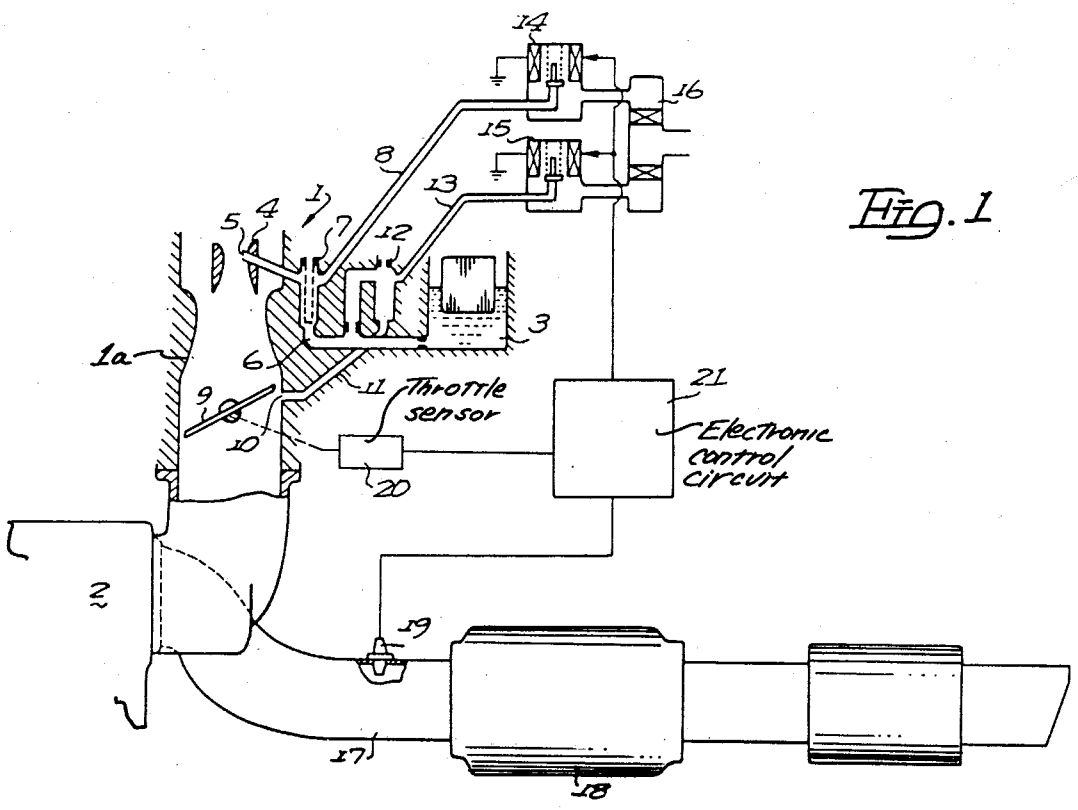
FIG. 1 is a schematic view of a system for controlling air-fuel ratio according to the present invention.

Referring to FIG. 1, a carburetor 1 communicates with an internal combustion engine 2 via an intake passage 1*a* of the carburetor. The carburetor comprises a float chamber 3, a venturi 4 in the intake passage 1*a*, a nozzle 5 communicating with the venturi communicates with the float chamber 3 through a main fuel passage 6, and a slow port 10 communicates with the float chamber 3 through a slow fuel passage 11. Air correcting passages 8 and 13 are provided in parallel to a main air bleed 7 and a slow air bleed 12, respectively. On-off type electromagnetic valves 14 and 15 are connected to the air correcting passages 8 and 13, respectively. An inlet port of each on-off electromagnetic valve communicates with the atmosphere through an air cleaner 16. An oxygen sensor 19 is mounted on an exhaust pipe 17 of the engine upstream of a three-way catalyst converter 18 and detects the oxygen concentration of the exhaust gases in the exhaust passage (exhaust pipe 17).

A throttle sensor 20 comprising a potentiometer-type transducer is connected to a throttle valve 9 in the intake passage 1*a* for detecting the degree of opening of the throttle valve 9. Output signals of the sensors 19 and 20 are sent to an electronic control circuit 21 for actuating the on-off type electromagnetic valves 14 and 15 to control the air-fuel ratio of the mixture to a value approximately equal to the stoichiometric air-fuel ratio.

Figure 2:
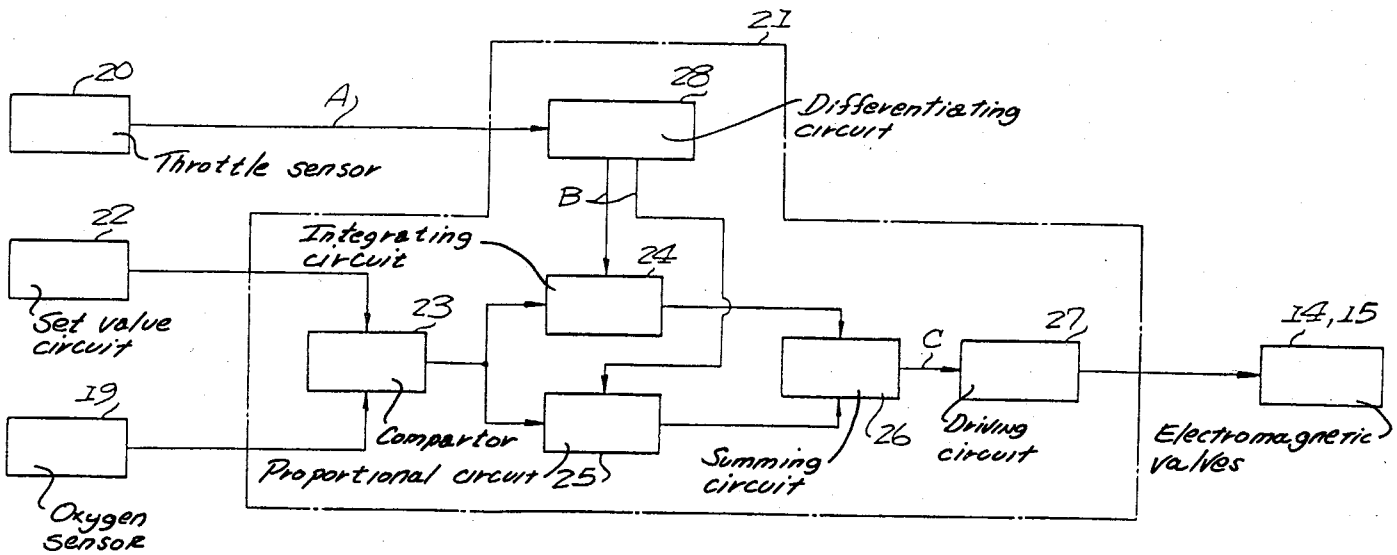
FIG. 2 is a block diagram of an electronic control circuit according to the present invention.

Referring to FIG. 2 showing more details of the electronic control circuit 21, the output signal of the oxygen sensor 19 is fed to a comparator 23 in the control circuit. The comparator 23 operates to compare the input signal with a set (predetermined) value applied from a set value circuit 22 to produce a deviation signal (a deviation from the set value). The deviation signal is fed to an integrating circuit 24 and a proportional circuit 25, so that the deviation signal is converted into proportional and integration signals. The proportional and integration signals are fed to a summing circuit 26 to form a proportional and integration signal at C. The proportional and integration signal is fed to a driving circuit 27 which produces square wave output pulses. The square wave output pulses are fed to both of the on-off type electromagnetic valves 14 and 15 for driving the valves.

When a rich air-fuel mixture is supplied to the engine and the exhaust gases have small oxygen concentration which is detected, the driving circuit 27 produces output pulses having a greater pulse duty ratio. These output pulses cause the opening times of the on-off type electromagnetic valves 14 and 15 to increase and as a result the amount of air passing through the valves 14 and 15 increases. Thus, the amount of air in the mixture fed from the carburetor 1 increases to thereby increase the air-fuel ratio. When a lean air-fuel ratio is detected, the driving output pulses have a small pulse duty ratio, whereby the air-fuel ratio is decreased to enrich the mixture fed from the carburetor.

Figures 3A, 3B, 3C:
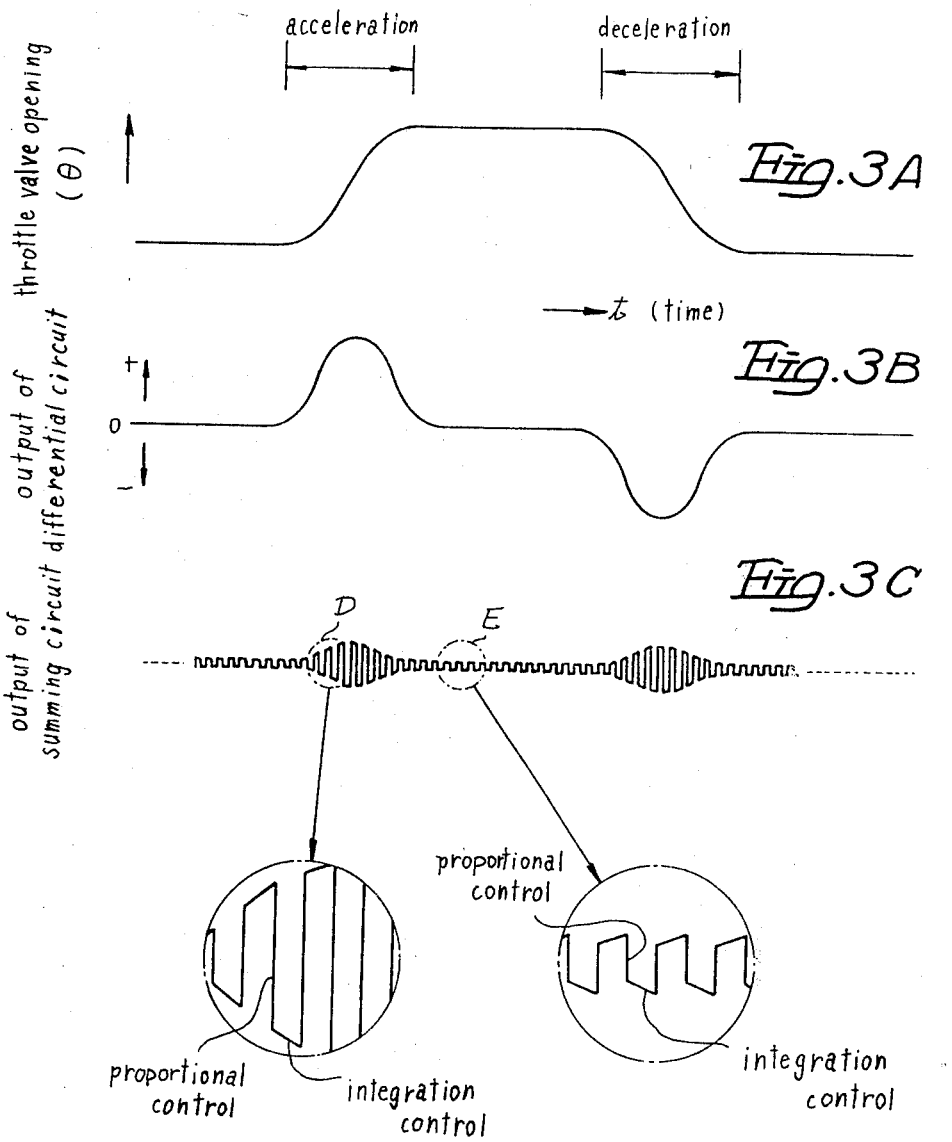
FIGS. 3A, 3B, 3C show waveforms at various locations in FIG. 2.

When the throttle valve 9 is rapidly operated to accelerate or decelerate the engine, the output voltage of the throttle sensor 20 varies according to the opening degree of the throttle valve. The output voltage of the throttle sensor 20 is applied to a differentiating circuit 28 which differentiates the variation A of the output voltage producing an output voltage B. FIG. 3A shows the variation A of the output voltage of the throttle sensor 20 during the acceleration and deceleration and FIG. 3B shows the output voltage of the differentiating circuit 28. The output voltage B of the differentiating circuit is applied to the integrating circuit 24 and to the proportional circuit 25 for increasing the constant of each circuit 24 and 25. The constant is increased in proportion to the output voltage of the differentiating circuit 28.

FIG. 3C shows the output waveform of the summing circuit 26. From the figure, it will be seen that the amplitude of the proportional control range is increased with the increase of the differentiation output voltage B and the inclination of the integration control range is also increased as shown by "magnified by sections D" in comparison with the normal operating condition shown by "E" (both magnified sections covering the equal time intervals).

In accordance with the present invention, since the constant of each circuit is increased during acceleration and deceleration of the engine, variation of the air-fuel ratio rapidly converges to the stoichiometric ratio. Thus, it is possible to improve the purification effect of the emission control system.

Figure 4:
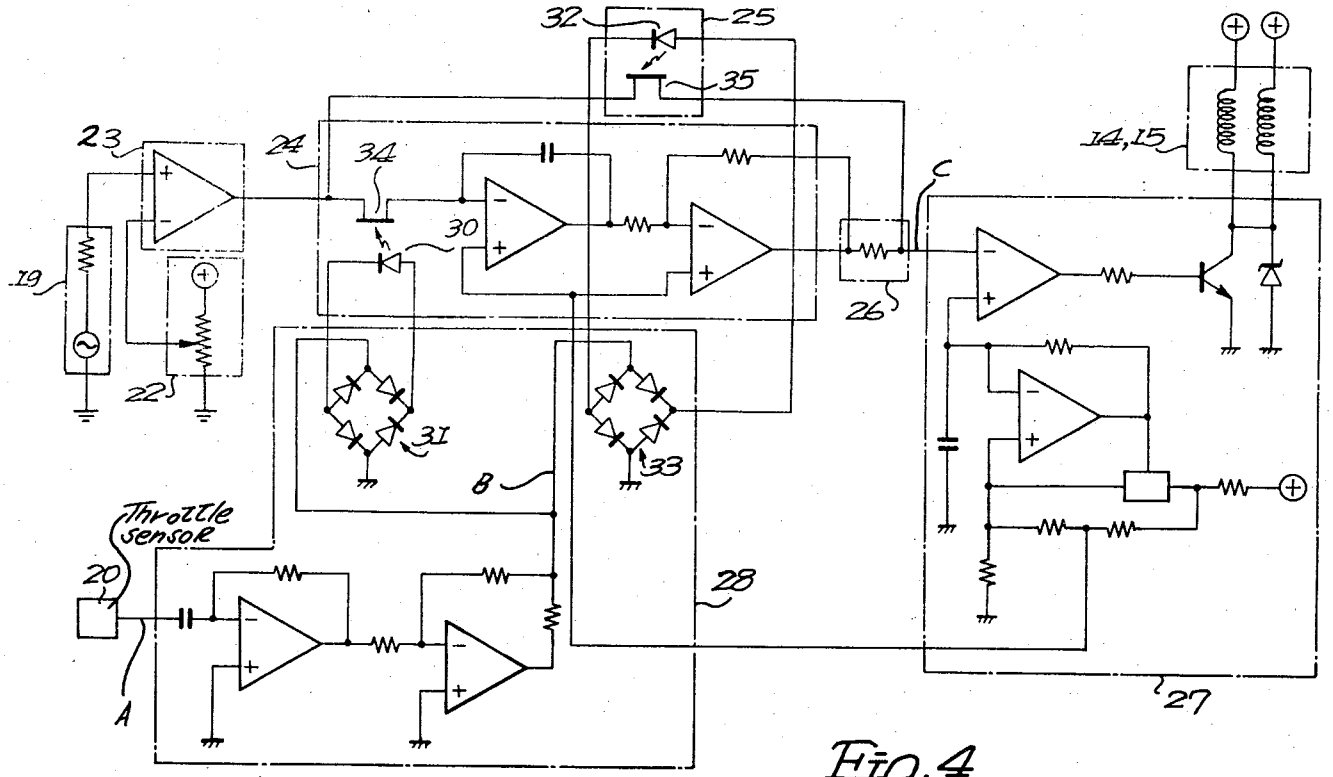
FIG. 4 is an example of the electronic control circuit.

FIG. 4 shows an example of the electronic control circuit. The same reference numerals as in FIG. 2 are used to identify the same parts. The output of the differentiating circuit 28 is bifurcated to a pair of outputs one of which is applied to a light emitting diode 30 of the integrating circuit 24 through a rectifier 31 and the other is applied to a light emitting diode 32 through a rectifier 33. The light emitting diodes 30 and 32 are combined with phototransistors 34 and 35 respectively. Resistance of each phototransistor varies with the differentiation output, so that the constant of each circuit 24 and 25 increase with an increase of the differentiation output voltage.

What is claimed is:

1. In a system for controlling the air-fuel ratio control for an internal combustion engine of the type having a carburetor with an intake passage, air-fuel mixture supply means for supplying an air-fuel mixture to the intake passage, an exhaust passage communicating with the engine, a throttle valve in the intake passage, detecting means for detecting the concentration of a constituent of exhaust gases passing through said exhaust passage and producing an output signal dependent thereon, comparator means for comparing said output signal of said detecting means with a set value and producing an output signal dependent thereon, an integrating circuit and a proportional circuit connected to said comparator means, a driving circuit connected to said integrating and proportional circuits for producing an output signal in dependency on said output signal of said integrating and proportional circuits, an electromagnetic valve means actuated by the output signal of said driving circuit for correcting the air-fuel ratio of the air-fuel mixture supplied by said air-fuel mixture supply means, throttle sensing means for detecting the operation of said throttle valve and producing an output signal dependent on the magnitude of acceleration and deceleration respectively of said internal combustion engine, and a circuit for varying the constant of said integrating and proportional circuits, the improvement comprising differentiating circuit means for differentiating the output signal of said throttle sensing means and for producing an output signal dependent on said acceleration and deceleration, respectively, rectifier means for rectifying said output signal of said differentiating circuit means, and semiconductor element means, having a resistance which varies with a variation of voltage applied thereto, for increasing the constants of said integrating and proportional circuits with an increase in the output signal of said rectifier means.

2. The system as set forth in claim 1, wherein said semiconductor element means comprises a light emitting diode connected across said rectifier means and a phototransistor having said resistance arranged so as to cooperate with said light emitting diode, said resistance of said phototransistor is connected in said proportional circuit and said integrating circuit, respectively.

3. The system as set forth in claim 2, wherein said rectifier means constitutes a bridge comprising two parallel branches of serially connected diodes with an input at a midpoint of one of said branches, a ground at midpoint of the other of said branches, and the ends of said branches are connected across said light emitting diode.

4. The system as set forth in claim 3, wherein two of said light emitting diodes, one in each of said proportional circuit and said integration circuits.

5. The system as set forth in claim 3, wherein said resistance is connected to an output of said comparator means.

6. The system as set forth in claim 3, wherein said throttle sensing means is a potentiometer-type transducer operatively connected to said throttle valve.

7. The system as set forth in claim 3, wherein said semiconductor element means increases the constants of said integrating and proportional circuits in proportion to the magnitude of the output signal of said differentiating circuit means.

* * * * *